US012560407B2

(12) United States Patent
Batchelder et al.

(10) Patent No.: US 12,560,407 B2
(45) Date of Patent: Feb. 24, 2026

(54) TARGET LEAD ESTIMATION BASED ON LAUNCHER SLEW

(71) Applicant: BAE Systems Information and Electronic Systems Integration Inc., Nashua, NH (US)

(72) Inventors: Jason H. Batchelder, Lyndeborough, NH (US); Matthew F. Chrobak, Groton, MA (US); Tyler Nickerson, Mason, NH (US); Samuel C. Blauvelt, South Berwick, ME (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 321 days.

(21) Appl. No.: 18/460,282

(22) Filed: Sep. 1, 2023

(65) Prior Publication Data

US 2025/0076000 A1 Mar. 6, 2025

(51) Int. Cl.
*F41F 3/045* (2006.01)
*F41G 3/06* (2006.01)
(Continued)

(52) U.S. Cl.
CPC ..... *F41F 3/045* (2013.01); *F41G 3/06* (2013.01); *F41G 3/165* (2013.01); *F41G 7/36* (2013.01)

(58) Field of Classification Search
CPC ..... F41F 3/045; F41F 3/0455; F41G 3/06; F41G 3/165; F41G 7/36
See application file for complete search history.

(56) References Cited

U.S. PATENT DOCUMENTS 3,868,883 A * 3/1975 Tucker ..... F41G 7/305 89/1.8
4,008,869 A 2/1977 Weiss
(Continued)

FOREIGN PATENT DOCUMENTS

DE 10121690 A1 * 2/2002 ..... F41G 3/00
DE 19922412 B4 * 5/2009 ..... F41G 7/2293
(Continued)

OTHER PUBLICATIONS

International Search Report, PCT/US24/43061, mailed Jul. 11, 2025, 11 pages.

*Primary Examiner* — Gabriel J. Klein
(74) *Attorney, Agent, or Firm* — Sand, Sebolt & Wernow LPA; Gary McFaline

(57) ABSTRACT

A portable launcher to launch a guided projectile at an aerial target, wherein the guided projectile has a projectile guidance kit and a target leading guidance kit that is provided with the guided projectile and the portable launcher. The target leading guidance kit includes a target lead estimation protocol stored on a computer readable media and accessible by a processor of the target leading guidance kit. When the processor executes the target lead estimation protocol, the processor is instructed to dynamically lead a reticle of an electronic sight of the target leading guidance kit from the initial target position to the lead target position in response to the projectile guidance kit detecting a speed of the aerial target and an inertial measurement unit of the target leading guidance kit that measures the slew of the guided projectile from the initial position to the translated position.

8 Claims, 10 Drawing Sheets

(51) Int. Cl.
*F41G 3/16* (2006.01)
*F41G 7/36* (2006.01)

(56) References Cited

U.S. PATENT DOCUMENTS

| | | | | | |
|---|---|---|---|---|---|
| 4,243,187 | A * | 1/1981 | Esker | F41G 7/26 | 244/3.13 |
| 4,777,861 | A * | 10/1988 | Lecuyer | F41G 5/08 | 89/1.813 |
| 5,347,910 | A * | 9/1994 | Avila | F41G 7/2293 | 89/41.22 |
| 5,822,713 | A * | 10/1998 | Profeta | F41G 3/08 | 342/67 |
| 10,048,039 | B1 * | 8/2018 | Bell | F41G 3/02 | |
| 11,953,294 | B1 * | 4/2024 | Barfoot | F41H 13/0056 | |
| 2012/0145786 | A1 * | 6/2012 | Weaver | F41G 3/165 | 235/407 |
| 2013/0181047 | A1 * | 7/2013 | Santini | F41G 3/16 | 235/404 |
| 2017/0307334 | A1 * | 10/2017 | Greenwood | F41G 7/2293 | |

FOREIGN PATENT DOCUMENTS

| | | | | |
|---|---|---|---|---|
| DE | 202019106216 | U1 * | 2/2021 | F41G 3/00 |
| EP | 0448898 | A1 * | 10/1991 | F41F 3/0455 |
| FR | 2969273 | A1 * | 6/2012 | F41G 7/007 |
| WO | WO-0210665 | A1 * | 2/2002 | F41F 3/0465 |

* cited by examiner

TARGET LEAD ESTIMATION BASED ON LAUNCHER SLEW

TECHNICAL FIELD

The present disclosure generally relates to portable air defense systems or man-portable air defense system (MANPADS).

BACKGROUND ART

Portable air defense systems or man-portable air defense systems (MANPADS) are surface-to-air artillery platforms that can be carried and fired by a single individual or operator or carried by several individuals or operators and fired by more than one operator acting as a crew. Generally, these MANPADS consist of a surface-to-air missile, a launch tube configured to house and launch the surface-to-air missile, a launching mechanism of the launch tube for initiating and/or activating the launch of the surface-to-air missile, and a thermal battery used to power the missile prior to launch. Normally, these MANPADs are the last missile-based air defenses available to protect military forces against aerial attacks and are deployed in tandem with gun-types systems for neutralizing said aerial attacks.

Since MANPADS are normally the last missile-based air defenses available, these MANPADS generally include basic and/or rudimentary aim systems for neutralizing aerial attacks. In one example, launchers of existing MANPADS systems use iron sights with fixed target leads to use when a target is crossing left or right of the iron sights. Such use of iron sights or fixed target leads leaves the operator with performing lead estimations and/or calculations in real-time to strike the crossing target. While these iron sights or fixed target leads are helpful for the operator, the operator must perform these lead estimations and/or calculations rather quickly and efficiently in order to prevent one or more aerial attacks on surrounding military forces as well as conserving ammunition in effectively neutralizing the target. Without such precision and quick calculation of lead, such MANPADS become detrimental for military forces when eliminating and/or neutralizing aerial attacks.

Moreover, launchers of existing MANPADS may use other guidance systems and/or navigation systems in order for the missile to strike the target (e.g., command line-of-sight (CLOS) systems, laser beam rider systems, etc.). However, these guidance systems and/or navigation systems still utilize iron sights and/or fixed target leads provided on the launcher which still leaves the operator calculating lead of the missile relative to the speed and direction of the target. Furthermore, launchers of existing MANPADS are also pushing operators of these MANPADS to eliminate smaller targets at greater ranges while being fed vast amounts of information through digital sighting systems while still using fixed target leads. As such, a need is necessary for assisting operators of MANPADS in efficiently using these systems during military operations.

SUMMARY OF THE INVENTION

In one aspect, an exemplary embodiment of the present disclosure may provide a portable launcher to launch a guided projectile at an aerial target, wherein the guided projectile has a projectile guidance kit and a target leading guidance kit that is provided with the guided projectile and the portable launcher. The target leading guidance kit may include an inertial measurement unit that is operably engaged with the guided projectile for tracking slew of the guided projectile inside of the portable launcher from an initial position to a translated position. The target leading guidance kit may also include a processor that is in electrical communication with the inertial measurement unit. The target leading guidance kit may also include an electronic sight that operably engages with the portable launcher and is in electrical communication with the inertial measurement unit and the processor. The target leading guidance kit may also include a target lead estimation protocol that is stored on a computer readable media and is accessible by the processor. When the processor executes the target lead estimation protocol, the processor is instructed to dynamically lead a reticle of the electronic sight of the target leading guidance kit from the initial target position to the lead target position in response to the projectile guidance kit detecting a speed of the aerial target and the inertial measurement unit measuring the slew of the guided projectile from the initial position to the translated position.

This exemplary embodiment or another exemplary embodiment may further include that when the processor executes the target lead estimation protocol, the reticle is displayed on the electronic sight from the initial target position to the lead target position in response to a seeker device on the guided projectile detecting the speed of the aerial target and the inertial measurement unit detecting the slew of the guided projectile from the initial position to the translated position. This exemplary embodiment or another exemplary embodiment may further include that the target lead estimation protocol comprises: a target locking function stored on the computer readable media in electrical communication with the processor; wherein the target locking function is executable by the processor to lock onto the target in response to the target being detected by the seeker device. This exemplary embodiment or another exemplary embodiment may further include that the target lead estimation protocol further comprises: a slew measuring function stored on the computer readable media and in electrical communication with the processor; wherein the slew measuring function is executable by the processor to measure the slew of the guided projectile in response to the inertial measurement unit detecting the slew of the guided projectile from the initial position to the translated position. This exemplary embodiment or another exemplary embodiment may further include that the target lead estimation protocol further comprises: a lead position function stored on the computer readable media and in electrical communication with the processor; wherein the lead position function is executable by the processor to calculate the lead target position in response to the seeker device detecting a speed of the aerial target and the inertial measurement unit measuring slew of the guided projectile from the initial position to the translated position. This exemplary embodiment or another exemplary embodiment may further include that the target lead estimation protocol further comprises: a reticle adjustment function stored on the computer readable media an in electrical communication with the processor; wherein the reticle adjustment function is executable by the processor to dynamically move the reticle of the electronic sight from the initial target position to the lead target position that matches the lead target position. This exemplary embodiment or another exemplary embodiment may further include a transceiver of the target leading guidance kit operably engaged with the portable launcher and is in electrical communication with a processor of the projectile guidance kit; wherein the processor is in electrical communication with the electronic sight on the guided projective via the transceiver. This exemplary embodiment or another exemplary embodiment may further include that the computer readable media is a legacy component of the guided projectile and the target leading estimation protocol is configured to be uploaded and stored on the computer readable media.

In another aspect, another exemplary embodiment of the present disclosure may provide a method. The method comprises steps of: providing a target lead guidance kit with a guided projectile and a portable launcher of a portable air defense system, the target lead guidance kit comprises: an inertial measurement unit operably engaging with the guided projectile for tracking slew of the guided projectile; a processor operably engaging with the inertial measurement unit and in electrical communication with the inertial measurement unit; an electronic sight operably engaging with the portable launcher and in electrical communication with the inertial measurement unit, a seeker device of the guided projectile of the portable air defense system, and the processor and having a reticle; and a target lead estimation protocol stored on a computer readable media that is electrical communication with the processor; wherein the processor is configured to execute the target lead estimation protocol loaded on the computer readable media which, when executed by the processor, causes the processor to: command the seeker device to detect an aerial target at an initial position; and command the electronic sight to dynamically move the reticle from an initial target position to a lead target position in response to the seeker device detecting a speed of the aerial target and the target leading guidance kit measuring slew of the guided projectile from an initial position to a translated position.

This exemplary embodiment or another exemplary embodiment may further include that when the target lead estimation protocol is executed by the processor, the processor is further caused to: lock onto the aerial target in response to the aerial target being detected by the seeker device upon executing a target locking function loaded on the computer readable media. This exemplary embodiment or another exemplary embodiment may further include that when the target lead estimation protocol is executed by the processor, the processor is further caused to: measure the slew of the guided projectile in response to the inertial measurement unit detecting the slew of the guided projectile when the portable air defense system is tracking the aerial target upon executing a slew measuring function loaded on the computer readable media. This exemplary embodiment or another exemplary embodiment may further include that when the target lead estimation protocol is executed by the processor, the processor is further caused to: calculate the lead target position of the aerial target in response to the seeker device detecting the speed of the aerial target and the guided projectile slewing from the initial position to the translated position upon executing a lead position function loaded on the computer readable media. This exemplary embodiment or another exemplary embodiment may further include that when the target lead estimation protocol is executed by the processor, the processor is further caused to: dynamically move the reticle of the electronic sight from the initial target position to the lead target position upon executing a reticle adjustment function loaded on the computer readable media. This exemplary embodiment or another exemplary embodiment may further include a step of effecting the guided projectile to be launched from the portable launcher at the lead target position.

In yet another aspect, another exemplary embodiment of the present disclosure may provide a computer program product stored on a computer readable media and executable by a processor of a portable air defense system for launching a guided projectile. The computer program product comprises of: executing, by the processor, a first step of the computer program product stored on the computer readable medium that instructs the processor to lock onto an aerial target in response to the aerial target being detected by the guided projectile; executing, by the processor, a second step of the computer program product stored on the computer readable medium that instructs the processor to measure the slew of the guided projectile between an initial position to a translated position; executing, by the processor, a third step of the computer program product stored on the computer readable medium that instructs the processor to calculate the lead target position in response to detecting a speed of the aerial target and measuring slew of the guided projectile from the initial position to the translated position; and executing, by the processor, a fourth step of the computer program product stored on the computer readable medium that instructs the processor to dynamically move a reticle provided on the portable air defense system from the initial target position to the lead target position that matches the lead target position.

This exemplary embodiment or another exemplary embodiment may further include that the first step of the computer program product further includes that the processor locks onto an aerial target in response to the aerial target being detected by a seeker device of a projectile guidance kit of the guided projectile that is in electrical communication with the processor. This exemplary embodiment or another exemplary embodiment may further include that the second step of the computer program product further includes that the processor measures the slew of the guided projectile between the initial position to the translated position in response to an inertial measurement unit operably engaged with the guided projectile for tracking slew of the guided projectile. This exemplary embodiment or another exemplary embodiment may further include that the third step of the computer program product further includes that the processor calculates the lead target position in response to a seeker device of the guided projectile detecting a speed of the aerial target and an inertial measurement unit measuring slew of the guided projectile from the initial position to the translated position. This exemplary embodiment or another exemplary embodiment may further include that the fourth step of the computer program product further includes that the processor dynamically moves the reticle on an electronic sight of the portable air defense system from the initial target position to the lead target position that matches the lead target position. This exemplary embodiment or another exemplary embodiment may further include that the first step, the second step, the third step, and the fourth step of the computer program product are performed prior to launching the guided projectile from the portable air defense system.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
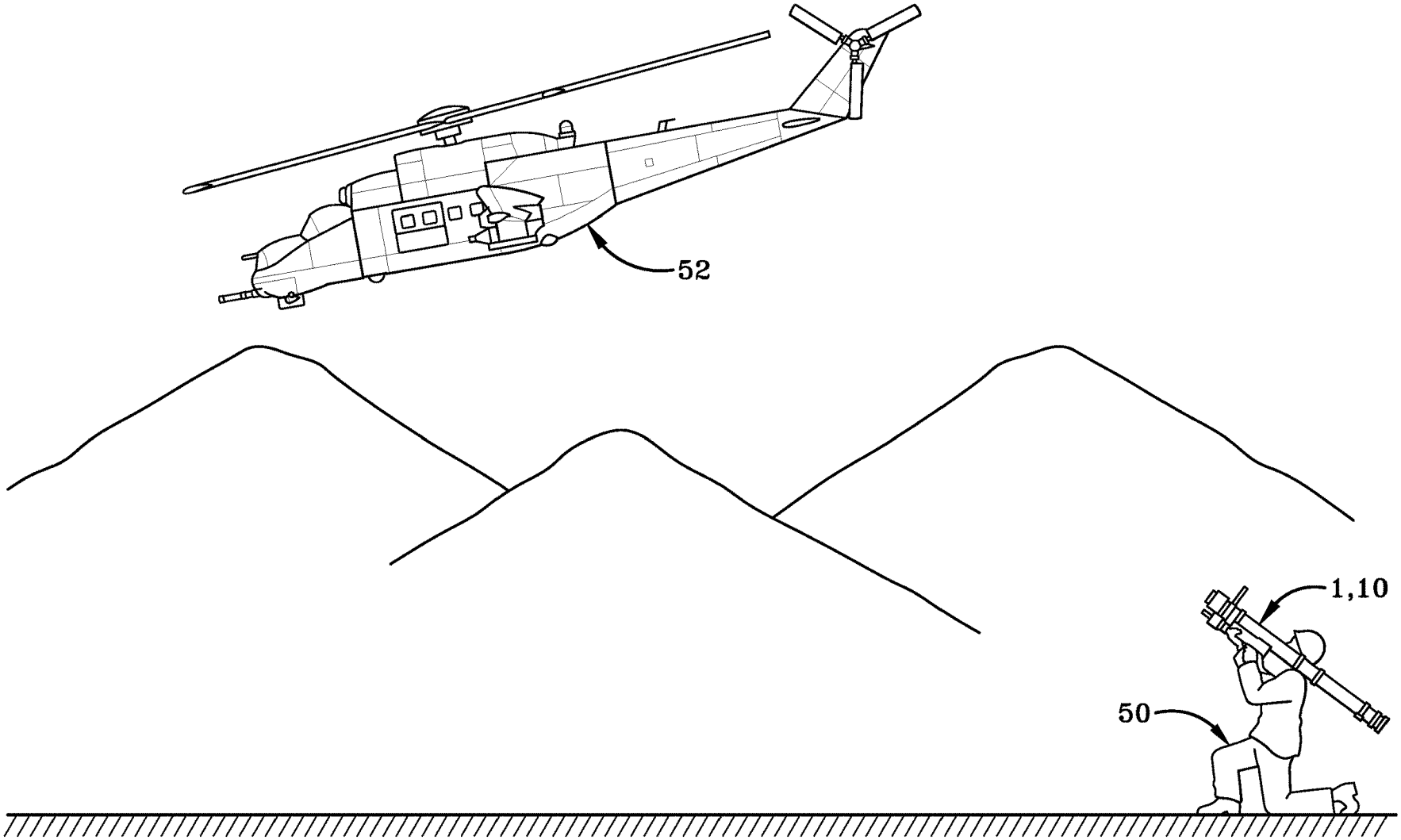
FIG. 1 (FIG. 1) is a diagrammatic view of an aerial target being tracked by a portable air defense system in accordance with one aspect of the present disclosure.
Figure 2:
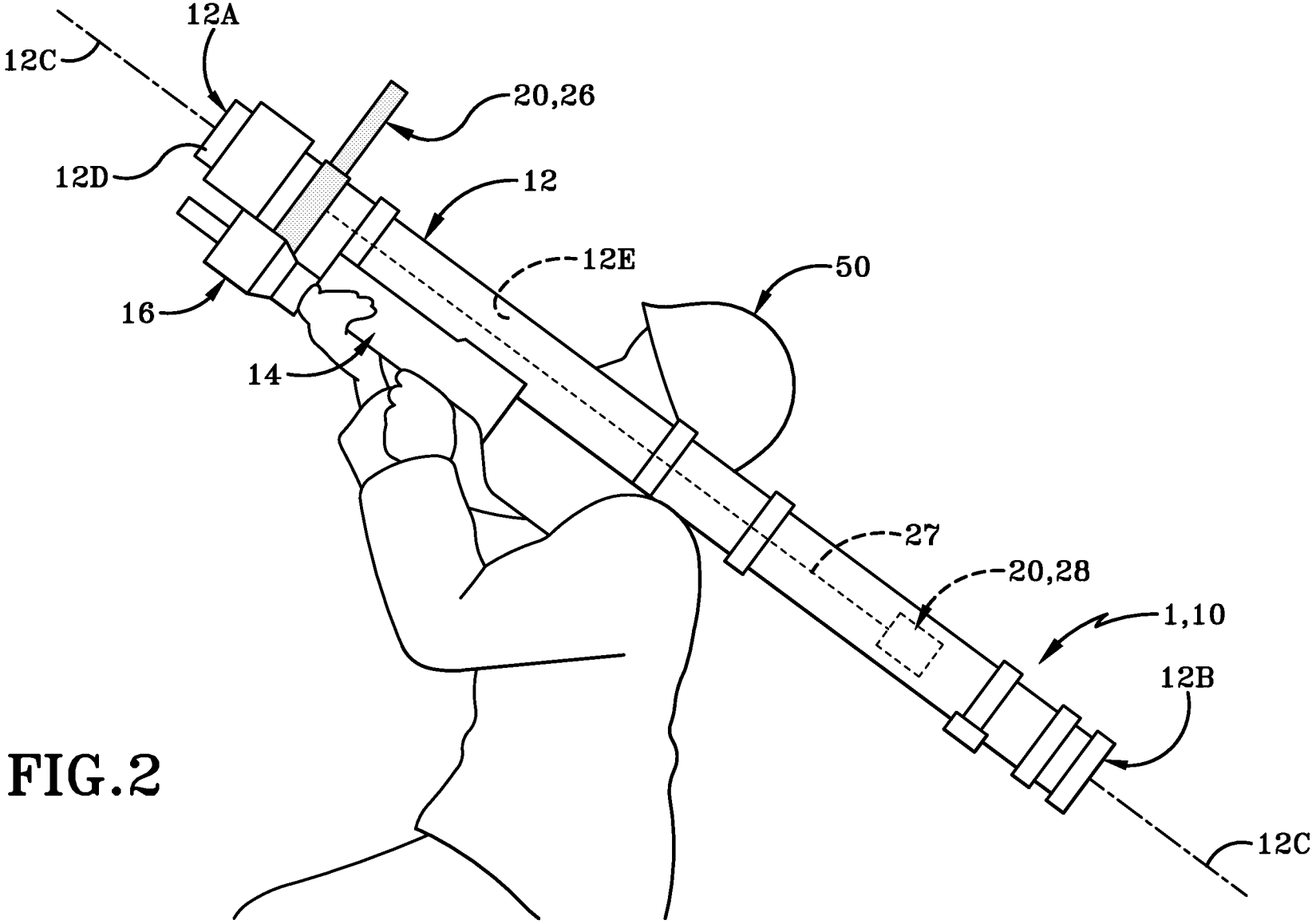
FIG. 2 (FIG. 2) is a diagrammatic view of a launcher of the portable air defense system.

FIGS. 1-2 illustrate a portable air defense system or man-portable air defense system (MANPADS) generally referred to as 1. In the present disclosure, portable air defense system 1 is configured to launch a surface-to-air projectile or missile for neutralizing an aerial target in one or more military operations, particularly aircrafts or air vehicles (manned or unmanned). As discussed in greater detail below, the portable air defense system 1 includes a target lead estimation protocol of a target leading guidance kit for dynamically leading a reticle of an electronic sight of the portable air defense system 1 from an initial target position to a lead target position in response to a portable launcher of portable air defense system 1 slewing from an initial position to a translated position when tracking an aerial target. Such components and features of the portable air defense system 1 are discussed in greater detail below.

Portable air defense system 1 includes a surface-to-air guided projectile or missile 2. It should be appreciated that missile 2 may be a conventional surface-to-air projectile that is normally launched from conventional portable air defense systems or MANPADSs in military operations. However, in the present disclosure, missile 2 includes a conventional and/or available guidance kit 4 having a first transceiver 4A that is configured to communicate with a target leading guidance kit of a launcher of the portable air defense system 1 via the first transceiver 4A; such communication between the missile 2 and the launcher of the portable air defense system 1 is discussed in greater detail below.

Missile 2 also includes a nose mounted imaging device or seeker device 4B that is electrically connected with the first transceiver 4A via an electrical communication 4C. In operation, the seeker device 4B is configured to search and detect an aerial target at a desired viewing angle (denoted by dashed lines labeled 5 in FIG. 5A) when in flight by measuring various light wavelengths emitted by an aerial targets, including, but not limited to, infrared wavelengths, visible light wavelengths, and ultraviolet wavelengths. In the present disclosure, the seeker device 4B is configured to search and detect aircrafts and air vehicles (manned or unmanned) when in flight by measuring various light wavelengths emitted by an aerial targets. In one exemplary embodiment, seeker device 4B discussed and illustrated herein is an electro-optical infrared ("EOIR") seeker device for searching and detecting aircrafts and air vehicles (manned or unmanned) when in flight by measuring infrared wavelengths emitted by the aircrafts or air vehicles (e.g., honing in on an aircraft's heat source, usually the engine or the engine's exhaust plume). As discussed in greater detail below, one or more light wavelengths detected by the seeker device 4B of missile 2 may be outputted and streamed to a launcher of the portable air defense system 1, via the first transceiver 4A, for assisting an operator in leading the missile 2. Particularly, such data and information collected by the seeker device 4B may be outputted and streamed to a target leading guidance kit of the launcher of the portable air defense system 1 to dynamically adjust and/or move a reticle of an electronic sight for assisting the operator in directing and leading the missile 2 towards an anticipated or lead position.

Missile 2 also includes a longitudinal direction 4D that extends between a first or fore end 4D1 of the missile and a second or aft end 4D2 of the missile. In operation, a target lead guidance kit 20 of the portable air defense system 1 may utilize the longitudinal direction 4D of the missile 2 when measuring slew applied to the missile 2 by an operator during target lead operations; such target lead operations are discussed in greater detail below.

Portable air defense system 1 also includes a launcher 10 configured for housing and launching missile 2 for neutralizing an aerial target in one or more military operations. As best seen in FIG. 2, launcher 10 includes a tubular body or launch tube 12 configured to house and launch missile 2 for neutralizing an aerial target in at least one military operation. Launch tube 12 includes a first end 12A, a second end 12B longitudinally opposite to the first end 12A, and a longitudinal or launch axis 12C defined therebetween. Launch tube 12 also defines a barrel or passageway 12D that extends longitudinally between the first end 12A and the second end 12B. While not illustrated herein, the barrel 12D is configured to house missile 2 prior to launching the missile 2 from the launcher 10 as configured in conventional launchers of portable air defense systems. Launch tube 12 also defines a chamber 12E between the first end 12A and the second end 12B that is configured to house a target leading guidance kit of the portable air defense system, which is discussed in greater detail below.

Launcher 10 also includes a grip stock or launching mechanism 14 that operably engages with the launch tube 12. As best seen in FIG. 2, the grip stock 14 is positioned proximate to the first end 12A of the launch tube 12 for ease of access. In the present disclosure, the launching mechanism 14 enables an operator of the launcher 10 to discharge and/or launch a surface-to-air missile from the launcher 10 while also providing a grip or handle for the operator.

Launcher 10 also includes a thermal battery 16 that operably engages with the launch tube 12 near the first end 12A (see FIGS. 1 and 2). In the present disclosure, thermal battery 16 is a single-use battery that is configured to provide power to missile 2 prior to launching missile 2 from inside of launch tube 12.

The missile 2 and launcher 10 collectively include a target leading guidance kit 20 that is housed inside of at least the missile 2 and/or operably engaged with the launch tube 12. It should be appreciated that target leading guidance kit 20 may include suitable components and devices for guiding an surface-to-air missile from the launch tube 12 to an enemy aircraft or air vehicle. As discussed in greater detail below, the target leading guidance kit 20 is configured to assist an operator of the portable air defense system 1 in dynamically leading the missile 2 towards a lead or anticipated positon of an enemy aircraft or air vehicle based on the measured speed and location of an aerial target (as detected by the seeker device 4B) and slew of the missile 2 applied by the operator when operating launcher 10. Such components and devices of the target leading guidance kit 20 are discussed in greater details below.

Figure 3:
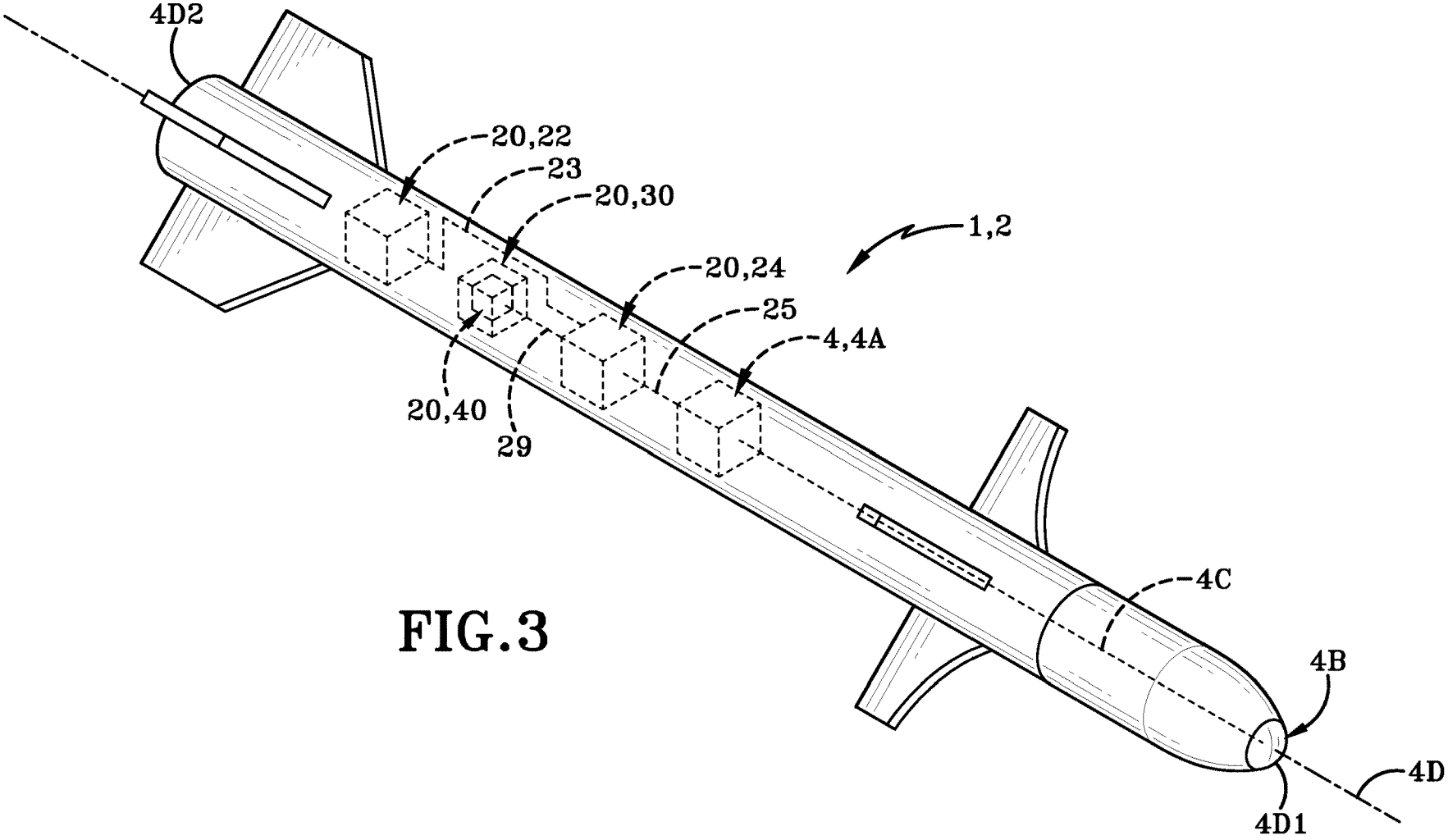
FIG. 3 (FIG. 3) is a diagrammatic view of a missile of the portable air defense system having a target lead estimation protocol.

Target leading guidance kit 20 may include an inertial measurement unit (or "IMU") 22. As best seen in FIG. 3, inertial measurement unit 22 of target leading guidance kit 20 may be housed inside the missile 2. In the present disclosure, inertial measurement unit 22 is configured to measure and output a measured force applied on the missile 2 by the operator when handling the launcher 10, an angular speed or slew applied on the missile 2 by the operator when handling the launcher 10, and, at times, a change of orientation applied on the missile 2 by the operator when tracking an aerial target. In one instance, inertial measurement unit 22 may measure and output the measured force applied on the missile 2 by the operator when handling the launcher 10, the angular speed or slew applied on the missile 2 by the operator when handling the launcher 10, and the change of orientation applied on the missile 2 by the operator relative to the longitudinal axis 4D of the missile 2.

In the present disclosure, the measurements and outputs of force, slew, and orientation applied on the missile 2 by the operator when handling the launcher 10 are determined by a combination of conventional accelerometers, gyroscopes, and magnetometers forming the inertial measurement unit 22. As such, any suitable and/or conventional inertial measurement unit or device may be used herein for measuring force, slew, and orientation applied on the missile 2 by the operator when handling the launcher 10 and tracking an aerial target. As discussed in greater detail below, the force, slew, and orientation applied on the missile 2 by the operator when handling the launcher 10 as measured by the inertial measurement unit 22 is used in combination with a target lead estimation protocol of the target leading guidance kit 20 for dynamically leading a reticle of an electronic sight of the portable air defense system 1 from an initial target position to a lead target position for neutralizing a targeted aircraft or air vehicle.

In the present disclosure, inertial measurement unit 22 may also be powered by an on-board power source and/or power supply (e.g., portable battery, etc.) in order to logically perform measurements of force, slew, and/or orientation of the missile 2 during military operations.

It should be understood that inertial measurement unit 22 may also be integrated with guidance kit 4 of missile 2 to assist in guiding the missile 2 to a desired target when in flight. As such, the inertial measurement unit 22 may be a preexisting and/or legacy guidance component originally installed and/or equipped to the missile 2 for assisting in preexisting and/or legacy guidance operations. Therefore, the inertial measurement unit 22 may be initially used in target lead guidance kit 20 to measure slew applied by the operator (when handling the launcher 10) for assisting in target lead adjustments prior to the missile 2 being launched at an aerial target and then be subsequently used to assist in guiding the missile 2 to said aerial target when in flight.

Target leading guidance kit 20 may also include at least one processor or processing unit 24. In the present disclosure, a single processor 24 is illustrated herein for schematic and diagrammatic purposes. In other exemplary embodiments, any suitable number of processors may be provided with a projectile for specific a military operation (e.g., guidance protocols and methods). Processor 24 is configured to logically perform protocols and/or methods that the processor 24 has access to prior to military operation, including guidance protocols and methods used in an existing guidance kit. The processor 24 may also be powered by an on-board power source and/or power supply (e.g., portable battery, etc.) in order to logically perform protocols and/or methods that are operatively in communication with the processor 24. The processor 24 may also be in logical communication with a tangible medium, such as a computer readable medium, for executing conventional guidance applications or protocols and/or novel guidance applications or protocols discussed herein.

As best seen in FIG. 3, processor 24 of target leading guidance kit 20 may be housed inside of missile 2. Still referring to FIG. 3, processor 24 is in electrical communication with the inertial measurement unit 22 via an electrical connection 23. In the present disclosure, processor 24 is configured to receive and use measured data outputted from the inertial measurement unit 22 (i.e., measured force, slew, and orientation applied on the missile 2 by the operator when handling the launcher 10), via the first electrical connection 23, when executing a target leading estimation protocol for assisting the operator in a guidance operation. It should be appreciated that any suitable and/or commercially-available processor or processing unit may be used for processor 24 described and illustrated herein.

Additionally, in the present disclosure, processor 24 is also configured to receive one or more signals from the seeker device 4B, via another electrical connection 24, when the seeker device 4B searches and detects an aerial target. It should be understood that processor 24 may receive one or more signals from the seeker device 4B via the electrical connection 4C that electrically connects the first transceiver 4A and seeker device 4B with one another and the electrical connection 24. As described in greater detail below, the detection of the aerial target by the seeker device 4B along with the slew measurements applied to the missile 2 by the operator as measured by the inertial measurement unit 22 enables the processor 24 to calculate a lead target position of the aerial target when executing a target lead estimation protocol.

It should be understood that electrical connections 23, 25 may be any suitable electrical connection or medium that provides electrical communication and/or logical communication between the inertial measurement unit 22 and the processor 24. In the present disclosure, electrical connection 23 is an electrical wire or cable that electrically connects the inertial measurement unit 22 with the processor 24 so that the inertial measurement unit 22 may output measured force, slew, and orientation applied on the missile 2 by the operator when handling the launcher 10 during a target lead operation. Similarly, electrical connection 25 is an electrical wire or cable that electrically connects the first transceiver 4A, the seeker device 4B, and the processor 24 so that the seeker device 4B may output one or more signals to the processor 24 when searching and detecting an aerial target during a target lead operation. In one exemplary embodiment, electrical connections 23, 25 may be a conventional wireless connection that electrically connects the inertial measurement unit 22 with the processor 24 and electrically connects the first transceiver 4A, the seeker device 4B, and the processor 24 with one another.

It should be understood that processor 24 may also be integrated with guidance kit 4 of missile 2 to assist in guiding the missile 2 to a desired target when in flight. As such, the processor 24 may be a preexisting and/or legacy guidance component originally installed and/or equipped to the missile 2 for assisting in preexisting and/or legacy guidance operations. Therefore, the processor 24 may be initially used in the target lead guidance kit 20 to execute a target lead guidance protocol of the target lead guidance kit 20 for making target lead adjustments prior to the missile 2 being launched at a desired target and then be subsequently used to assist in guiding the missile 2 to said desired target when in flight.

Target leading guidance kit 20 of launcher 10 also includes an electronic sight 26. As best seen in FIG. 2, electronic sight 26 may be operably engaged with launch tube 12 proximate to the first end 12 where the electronic sight 26 is spaced apart from the barrel 12D. Referring to FIG. 2, electronic sight 26 may also be in electrical communication with the processor 24 during a target lead operation via a transceiver of the target leading guidance kit 20, which is discussed in greater detail below.

In the present disclosure, electronic sight 26 includes a housing 26A that operably engages with the launch tube 12 and houses a digital screen 26B (see FIGS. 5B-5E). During operation, digital screen 26B is configured to display a reticle 26C to assist an operator of the launcher 10 when aiming the launcher 10 at an aerial target. As described in greater detail below, the reticle 26C dynamically moves and/or translates on the digital screen 26B, via the processor 24, from an initial aim position to a lead aim position to assist the operator in leading the missile 2 to strike and neutralize an aerial target; such dynamic movement applied to the reticle 26C is based on parameters of an aerial target detected by seeker device 4B and slew applied on the missile 2 by the operator when handling the launcher 10 as measured by the inertial measurement unit 22.

In the present disclosure, electronic sight 26 may also be powered by an on-board power source and/or power supply (e.g., portable battery, etc.) in order to stream a live view from the seeker device 4B and to display the reticle 26C during military operations.

It should also be appreciated that electronic sight 26 may be configured in any suitable manner in order to enable an operator of launcher 10 to view the far field via the electronic sight 26 when tracking a targeted aircraft or air vehicle. In the present disclosure, and as best seen in FIGS. 5A-5D, digital screen 26B of electronic sight 26 is electrically connected with seeker device 4B, through wireless communication, to stream the far field view of the seeker device 4B in real-time to assist the operator in tracking an aerial target. In this instance, reticle 26C may dynamically move and/or translate across the digital screen 26B as the operator is viewing the aerial target in the far field via the seeker device 4B transmitting a real-time view of the far field onto the digital screen 26B. In another exemplary embodiment, the digital screen 26B of electronic sight 26 may be substantially clear or transparent such that the operator of launcher 10 may view the far field through the electronic sight 26 when tracking a targeted aircraft or air vehicle. In this instance, reticle 26C may dynamically move and/or translate across the digital screen 26B as the operator is viewing the targeted aircraft or air vehicle in the far field.

Target leading guidance kit 20 may also include an output device or second transceiver 28. As best seen in FIG. 2, second transceiver 28 may be operably engaged with launch tube 12 and be positioned inside of chamber 12E where the second transceiver 28 is spaced apart from the barrel 12D. Referring to FIG. 2, second transceiver 28 may also be in electrical communication with the electronic sight 26 via another electrical connection 27. It should be appreciated that second transceiver 28 may also be powered by an on-board power source and/or power supply (e.g., portable battery, etc.) to communicate with the first transceiver 4A of missile 2 and the components of target leading guidance kit 20, particularly the processor 24.

In the present disclosure, second transceiver 28 is configured to receive one or more signals from the processor 24 of the target leading guidance kit 20 to generate a lead target position on the electronic sight 26 when the processor 24 executes a target lead estimation protocol, which is described in greater detail below. Particularly, second transceiver 28 is configured to receive one or more signals from the processor 24, via the first transceiver 4A of the missile 2, to generate a lead target position on the electronic sight 26 when executing a target lead estimation protocol. Such communication between processor 24, via the first transceiver 4A, and the second transceiver 28 is performed via a wireless electrical communication.

It should be understood that the electrical connection 27 may be any suitable electrical connection or medium that provides electrical communication and/or logical communication between the electronic sight 26 and the second transceiver 28. In the present disclosure, electrical connection 27 is an electrical wire or cable that electrically connects the electronic sight 26 and the second transceiver 28 with one another so that the processor 24 may instruct the electronic sight 26 to dynamically move the reticle 26C from an initial target position to a lead target position based on target lead calculations and/or data computed by the processor 24 upon executing a target lead estimation protocol of target leading guidance kit 20. In one exemplary embodiment, electrical connection 27 may be a conventional wireless connection that electrically connects the electronic sight 26 and the second transceiver 28 with one another so that the processor 24 may instruct the electronic sight 26 to dynamically move the reticle 26C from an initial target position to a lead target position based on target lead calculations and/or data computed by the processor 24 upon executing a target lead estimation protocol of target leading guidance kit 20.

Target leading guidance kit 20 also includes a computer readable medium or media 30. As best in FIGS. 3-4, target leading guidance kit 20 includes a computer readable medium 30 that may be housed inside of the missile 2. Still referring to FIGS. 3-4, computer readable medium 30 is in electrical communication with the processor 24 via an electrical connection 29. In the present disclosure, computer readable medium 30 is pre-loaded with a target lead estimation protocol 40 that is accessible and executable by the processor 24. When the processor 24 executes the target lead estimation protocol 40, the processor 24 dynamically leads the reticle 26C of electronic sight 26 of the target leading guidance kit 20 from an initial target position to a lead target position in response to the seeker device 4B of missile 2 detecting the aerial target in flight and an operator slewing or moving the missile 2 from an initial position to a translated position when handling the launcher 10. Such functions and/or steps provided in target lead estimation protocol 40 are discussed in greater detail below.

It should be understood that electrical connection 29 may be any suitable electrical connection or medium that provides electrical communication and/or logical communication between the processor 24 and the computer readable medium 30. In the present disclosure, electrical connection 29 is an electrical wire or cable that electrically connects the processor 24 and the computer readable medium 30 with one another so that the processor 24 may access and execute the target lead estimation protocol 40 during a military operation. In one exemplary embodiment, electrical connection 29 may be a conventional wireless connection that electrically connects the processor 24 and the computer readable medium 30 with one another so that the processor 24 may access and execute the target lead estimation protocol 40 during a military operation.

In the present disclosure, computer readable medium 30 may also be powered by an on-board power source and/or power supply (e.g., portable battery, etc.) in order to communicate with processor 24 so that processor 24 may access and execute the target lead estimation protocol 40 during military operations.

Figure 4:
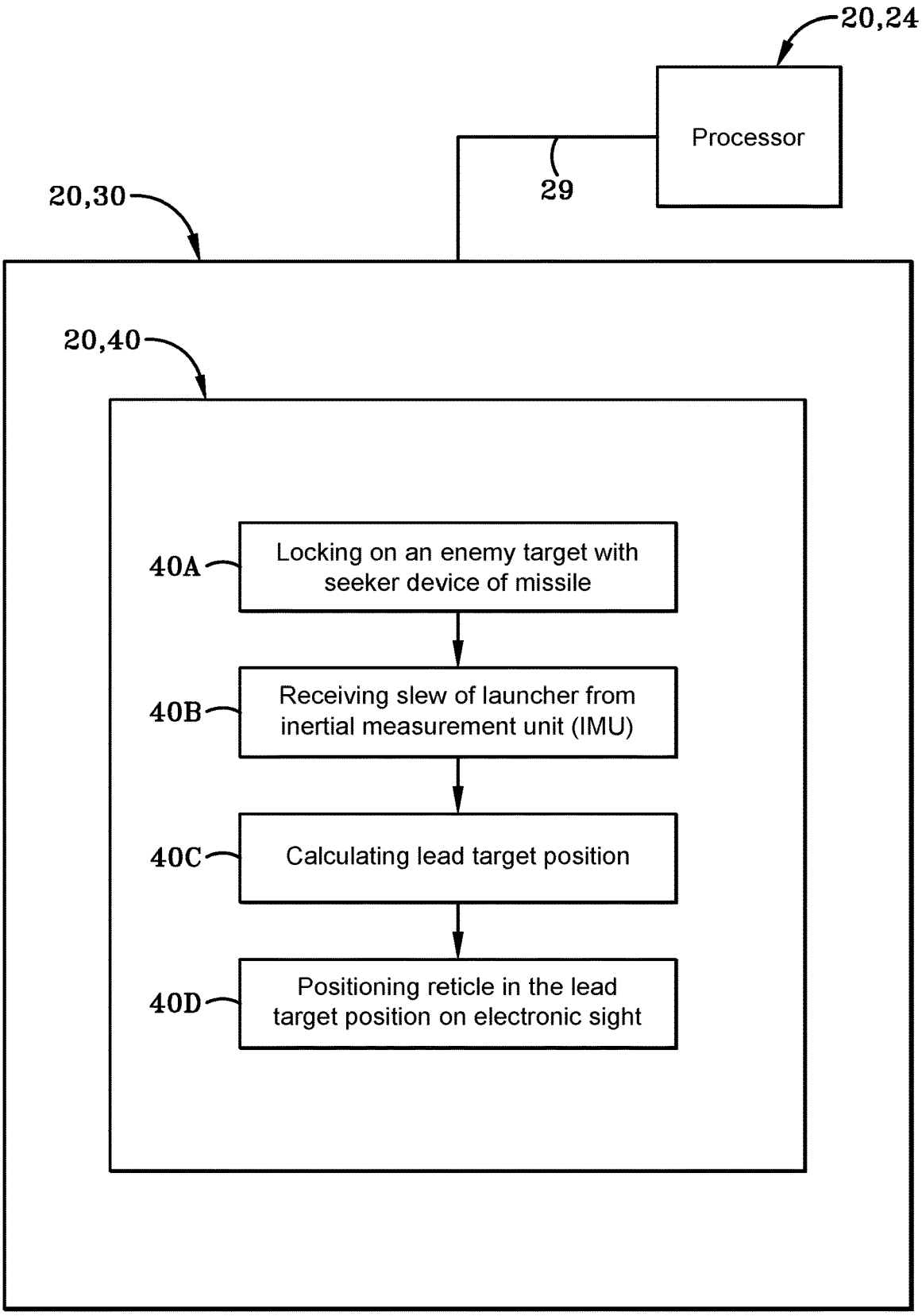
FIG. 4 (FIG. 4) is a schematic view of the target lead estimation protocol of the portable air defense system.

Target lead estimation protocol 40 may include a target locking function 40A. As best seen in FIG. 4, target locking function 40A is the initial function of the target lead estimation protocol 40 and is in logical communication with the processor 24 for execution.

In the present disclosure, the target locking function 40A is initiated by processor 24 once the seeker device 4B is powered to an operating state and begins searching and detecting the far field for an aerial target in flight (i.e., targeted aircrafts of air vehicles). Once executed by the processor 24, the first transceiver 4A and seeker device 4B are initiated and are provided in an operating state based on conventional guidance programs and/or protocols loaded into missile 2. Such initiation of the first transceiver 4A and seeker device 4B enables the seeker device 4B to output one or more signals to the target leading guidance kit 20, via the first transceiver 4A, for detecting an aerial target and streaming the live view from seeker device 4B. In operation, the target locking function 40A of target lead estimation protocol 40 may be continuously executed by the processor 24 until the seeker device 4B sends at least one output or measurement that detects the aerial target. Upon such detection, the target locking function 40A enables the processor 24 to use such outputs or measurements detected by the seeker device 4A to lock onto the aerial target for later estimating a lead target position.

Target lead estimation protocol 40 may also include a slew measuring function 40B. As best seen in FIG. 4, the slew measuring function 40B is in logical communication with the target locking function 40A such that the slew measuring function 40B is in series with the target locking function 40A and is executed by the processor 24 subsequent to the target locking function 40A. In one exemplary embodiment, processor 24 may execute the slew measuring function 40B concurrently with the target locking function 40A.

In operation, the slew measuring function 40B is configured to enable the processor 24 to retrieve and utilize force, slew, and/or orientation applied to the missile 2 by the operator (when handling the launcher 10) as measured and outputted by the inertial measurement unit 22. In the present disclosure, the slew measuring function 40B may be executed by processor 24 once inertial measurement unit 22 is powered to an operating state and begins measuring the force, slew, and/or orientation applied to the missile 2 by the operator when handling the launcher 10. The force, slew, and/or orientation applied to the missile 2 by the operator that is measured by inertial measurement unit 22 may be measured relative to the longitudinal direction 4D of the missile 2. As such, any slew applied to the missile 2 that is measured by the inertial measurement unit 22 is later utilized by the processor 24 for estimating a lead target position.

Target lead estimation protocol 40 may also include a lead position function 40C. As best seen in FIG. 4, the lead position function 40C is in logical communication with the slew measuring function 40B such that the lead position function 40C is in series with the slew measuring function 40B and is executed by the processor 24 subsequent to the slew measuring function 40B. In one exemplary embodiment, the lead position function 40C may be executed by the processor 24 concurrently with the slew measuring function 40B.

In the present disclosure, the lead position function 40C may be executed by processor 24 once inertial measurement unit 22 is powered to an operating state and begins measuring the force, slew, and/or orientation applied to the missile 2 by the operator when handling the launcher 10. In operation, the lead position function 40C is configured to enable the processor 24 to analyze and calculate an estimated lead position based on the detected and/or locked-on position of the aerial target, via the target locking function 40A, and the slew applied to the missile 2, via the slew measuring function 40B, by the operator when handling the launcher 10 and tracking the aerial target. Such calculations are performed based on relevant calculation formulas and procedures pre-loaded into the lead position function 40C for estimating the target lead of the aerial target.

Target lead estimation protocol 40 may also include a reticle adjustment function 40D. As best seen in FIG. 4, the reticle adjustment function 40D is in logical communication with the lead position function 40C such that the reticle adjustment function 40D is in series with the lead position function 40C and is executed by the processor 24 subsequent to the lead position function 40C. In one exemplary embodiment, the reticle adjustment function 40D may be executed by the processor 24 concurrently with the lead position function 40C.

In the present disclosure, the reticle adjustment function 40D may be executed by processor 24 once electronic sight 26 is powered to an operating state and begins displaying and/or illuminating reticle 26C on digital screen 26B. In operation, the reticle adjustment function 40D is configured to enable the processor 24 to instruct the electronic sight 26 to dynamically move the reticle 26C from an initial aim location to a lead aim location on the digital screen 26B. Such dynamic movement of the reticle 26C from the initial aim location to the lead aim location is performed once the lead target position is calculated by the lead position function 40C. It should be noted that processor 24 may instruct the electronic sight 26 by sending one or more outputs to the electronic sight 26 to dynamically move the reticle 26C based on the slew applied to the missile 2 by the operator when handling the launcher 10 and the speed of the aerial target measured by the seeker device 4B.

Such inclusion of the target lead estimation protocol 40 with a portable air defense system or MANPADS, such as portable air defense system 1 discussed herein, is considered advantageous at least because the target lead estimation protocol 40 provides assistance to the operator in automatically leading the missile 2 without the need of manually determining the lead of the missile 2 when utilizing fixed irons sights. With the target lead estimation protocol 40, the operator of the portable air defense system 1 is automatically provided with a lead target position (as indicated by the reticle 26C) by simply rotating and/or slewing the missile 2 (when handling the launcher 10) in the direction at which the aerial target is traveling. By tracking the speed and/or velocity of the aerial target by the seeker device 4B and measuring the slew of the missile 2 by the inertial measurement unit 22, the processor 24 is configured to execute the target lead estimation protocol 40 and automatically calculate a lead targeted position for the operator and dynamically move the reticle 26C to the calculated lead targeted position on the digital screen 26B.

Having now described the components and parts of the portable air defense system 1, a method of using the portable air defense system 1 to neutralize and/or eliminate an aerial target is discussed in greater detail below.

Prior to operating the portable air defense system 1 in a military operation, the operator (labeled 50 in FIGS. 1 and 5E) of portable air defense system 1 must prep the missile 2 and the launcher 10. In this prepping operation, the operator must load the missile 2 inside of the barrel 12D of the launch tube 12 and must engage the thermal battery 16 with the launch tube 12 to provide power to the missile 2 prior to launch. Once the portable air defense system 1 is prepped, the operator may then initiate the missile 2 and launcher 10 of the portable air defense system 1 to an operating state for a single launch operation. Particularly, devices and components of target lead guidance kit 20, including inertial measurement unit 22, processor 24, electronic sight 26, second transceiver 28, and computer readable medium 30, may be initiated to an operating state to dynamically and/or automatically aim the missile 2 at a lead target position prior to missile 2 being launched.

Once provided in the operating state, the guidance kit 4 of the missile 2 may be initiated to an operating state for searching and detecting the aerial target 52. Here, the seeker device 4B of the guidance kit 4 is powered to an operating state where the seeker device 4B begins searching for the aerial target 52 in the far field. Concurrently, processor 24 may execute the target locking function 40A of target lead estimation 40 in order to analyze and the process the location and speed of aerial target 52 once detected by the seeker device 4B. During this searching operation, seeker device 4B may output one or more signals to the processor 24 of the target leading guidance kit 20 that includes data and/or images viewed and detected by seeker device 4B. Such data and/or images sent from the seeker device 4B to the processor 24 is used for further analysis and processing of the location and speed of aerial target 52. Such data and/or images is also sent from the seeker device 4B to the second transceiver 28, via the first transceiver 4A, to stream a live view or real-time view of the far field as observed by the seeker device 4B onto the digital screen 26B of the electronic sight 26 (see FIGS. 5A-5D).

Figure 5A:
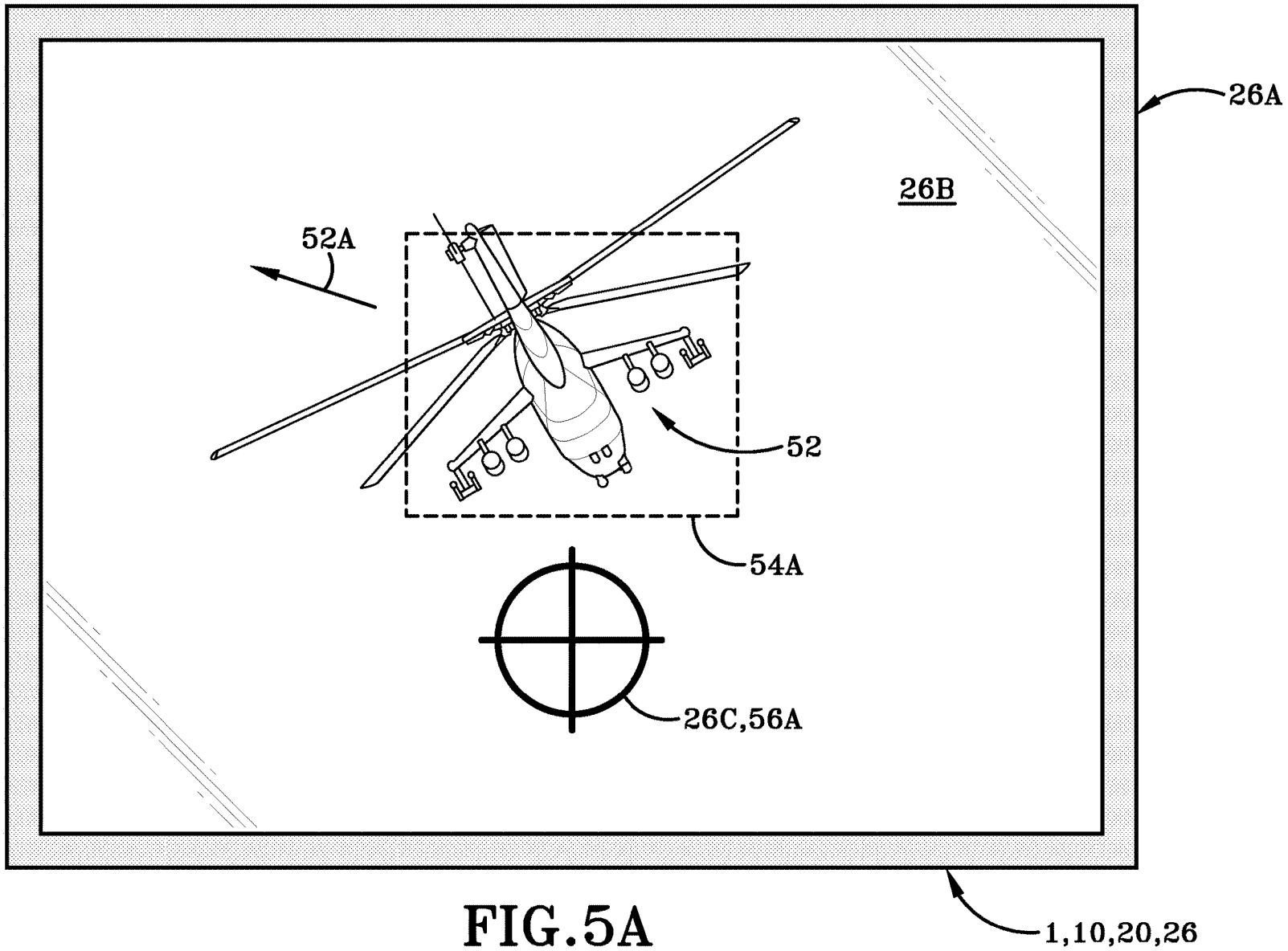
FIG. 5A (FIG. 5A) is an operational view of a seeker device of the missile viewing the aerial target and a target leading guidance kit detecting the aerial target at an initial target position, wherein a viewing angle of the seeker device is digitally streamed to an electronic sight of the target leading guidance kit of the launcher.

Once the data and/or images of the aerial target 52 is received, the processor 24 then determines the location and speed of aerial target 52 at a first or initial target position. As best seen in FIG. 5A, the processor 24 determines the location and speed of aerial target 52 at a first or initial target position (as denoted by a diagrammatic box labeled 54A in FIG. 5A). Such parameters of the initial target position 54A of the aerial target 52 may be stored in computer readable medium 30 or another medium of target leading guidance kit 20 that processor 24 may quickly access for later calculating the lead target position of aerial target 52.

Figure 5B:
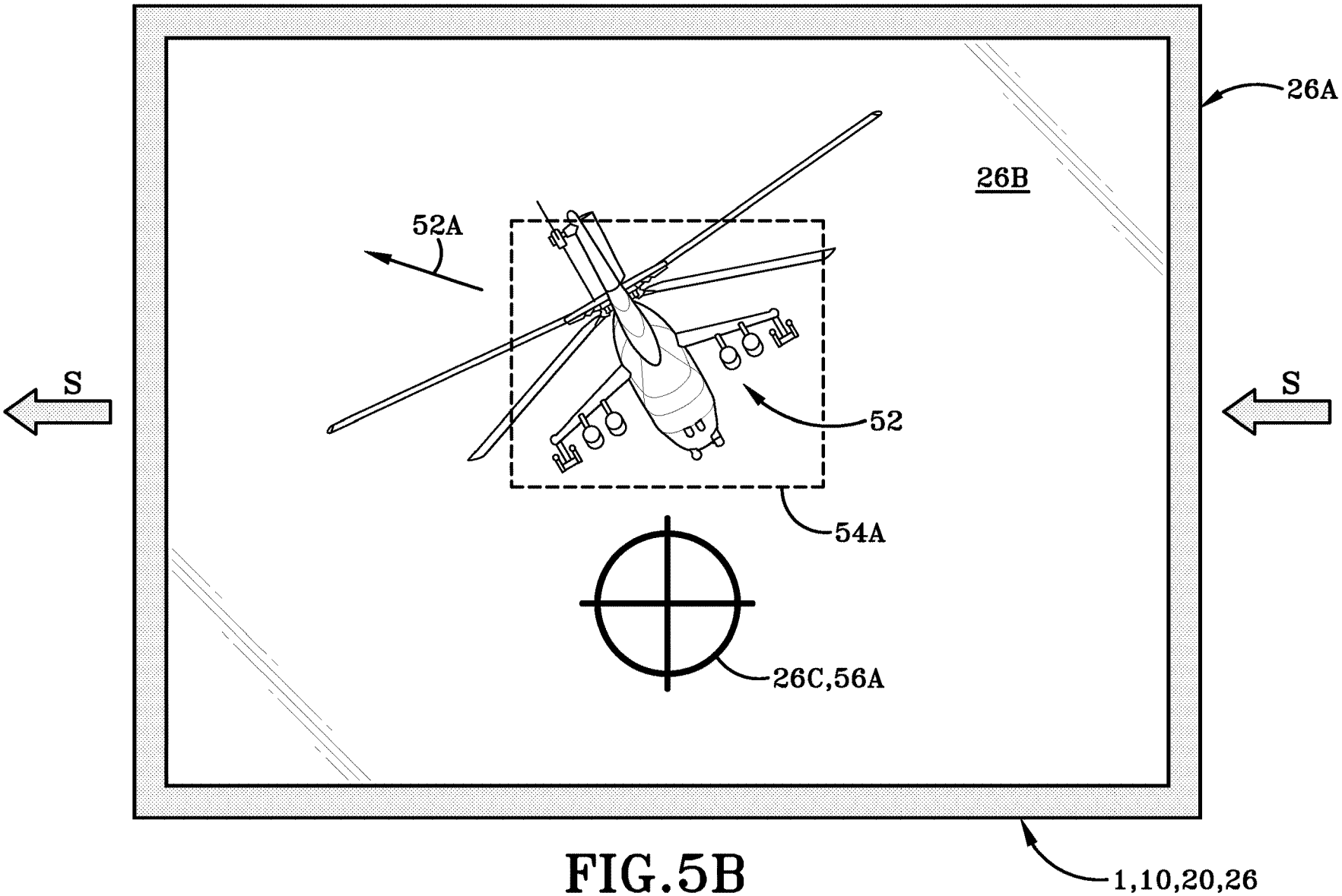
FIG. 5B (FIG. 5B) is another operational view similar to FIG. 5A, but slew is applied to the missile, by the operator, as the operator tracks the aerial target in a first direction.

Once the initial target position 54A is found, processor 24 may then receive one or more outputs from the inertial measurement unit 22 as the operator applies slew to the missile 2 when handling the launcher 10. As best seen in FIG. 5B, the operator is shown applying slew to the missile 2 when handling the launcher 10 in a direction that is following or tracking the flight direction 52A of the aerial target 52 in the far field when viewing the video stream on the digital screen 26B as outputted by the seeker device 4B. Such application of slew to the missile 2 by the operator when handling the launcher 10 is denoted by arrows labeled "S" in FIGS. 5B and 5C. As stated previously, the inertial measurement unit 22 is configured to record and measure force, slew, or orientation change of the missile 2 relative to the longitudinal direction 4D of the missile 2. In this example, the inertial measurement unit 22 begins recording and outputs measured slew to the processor 24 once the operator begins tracking the aerial target 52 and applies slew to missile 2 when handling the launcher 10.

Once the slew data is received by the processor 24, the processor 24 then executes the slew measuring function 40B to determine the rate and/or speed at which the missile 2 is slewing and/or moving. In the present operation, the processor 24 continuously analyzes and processes that rate and/or speed at which the missile 2 is slewing and/or moving as data is outputted from the inertial measurement unit 22. Such parameters of the speed at which the missile 2 is slewing and/or moving may be stored in computer readable medium 30 or another medium of target leading guidance kit 20 that processor 24 may quickly access for later calculating the lead target position.

Once the processor 24 possess the speed and location of aerial target 52 at an initial target position 54A and the speed at which the missile 2 is slewing and/or moving as applied by the operator inside of the launcher 10, processor 24 may then execute the lead position function 40C. As discussed previously, processor 24 may access guidance formulas and/or equations pre-loaded into the lead position function 40C for calculating the target crossing value or lead target position based on the information received from the seeker device 4B and the inertial measurement unit 22. Particularly, processor 24 may access guidance formulas and/or equations pre-loaded into the lead position function 40C for calculating the target crossing value or lead target position based on the speed and position of the aerial target 52 at the initial target position 54A and the speed at which the missile 2 is slewing and/or moving as applied by the operator when inside of the launcher 10.

Figure 5C:
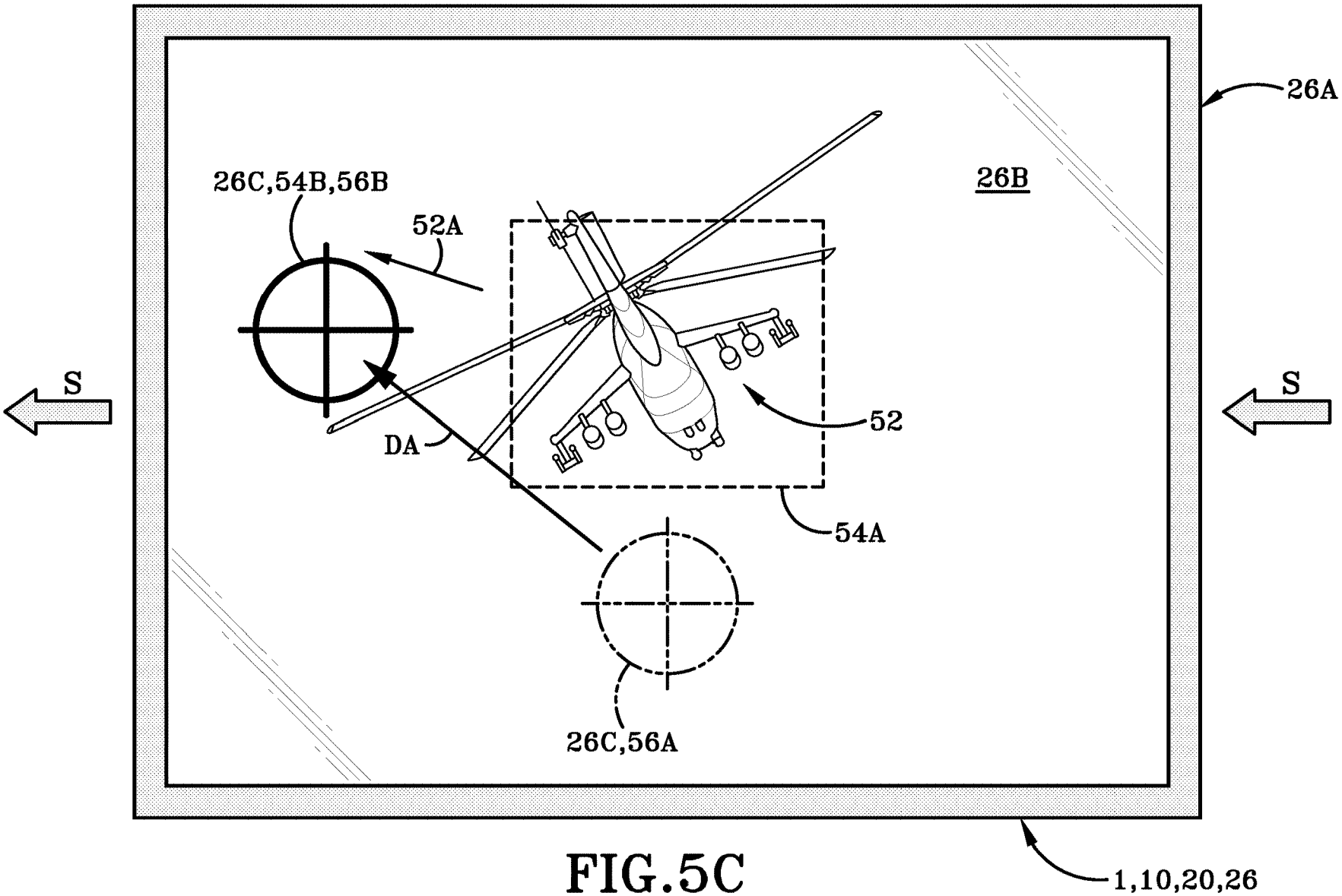
FIG. 5C (FIG. 5C) is another operational view similar to FIG. 5B, but a reticle of the guidance kit of the launcher dynamically moves from an initial aim position to a lead aim position for leading the missile to a lead target position ahead of the aerial target.
Figure 5D:
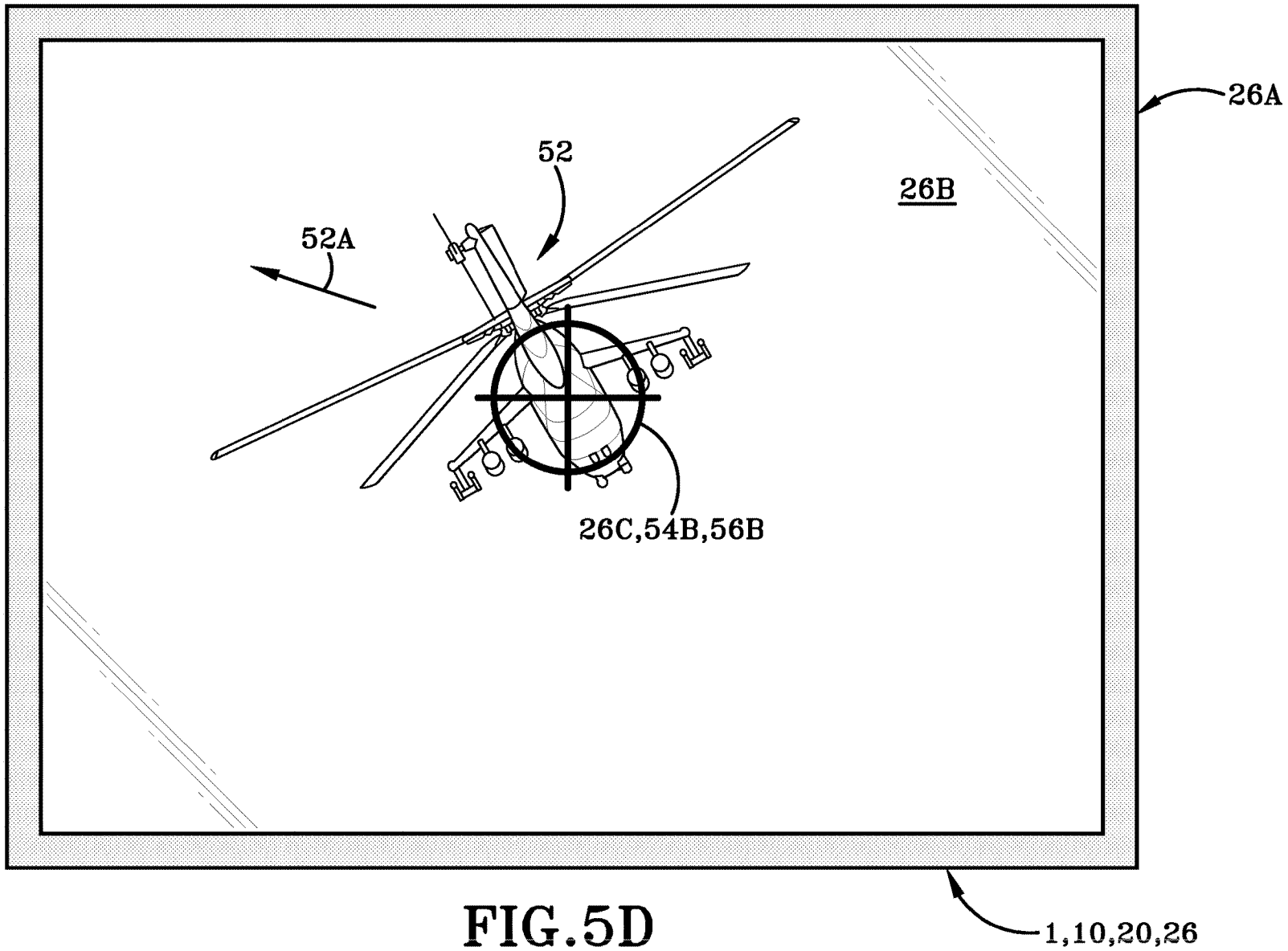
FIG. 5D (FIG. 5D) is another operational view similar to FIG. 5C, but the reticle of the guidance kit is at the lead aim position to assist an operator of the launcher to direct the missile to the lead target position of the aerial target.

Upon such calculation of the lead target position, the processor 24 is then configured execute the reticle adjustment function 40D of target lead estimation protocol 40. Upon such execution, processor 24 is configured to instruct the electronic sight 26, via the first transceiver 4A and the second transceiver 28, to dynamically move the reticle 26C for applying a corrected lead to assist the operator in this guidance operation. In the present disclosure, the processor 24 commands the electronic sight 26 to dynamically move and/or adjust the reticle 26C, via the reticle adjustment function 40D, from a first or initial aim position 56A (as seen in FIGS. 5A-5B) to a second or lead aim position 56B (as seen in FIGS. 5C-5D); such dynamic adjustment of the reticle 26C from the initial aim position 56A to the lead aim position 56B is denoted by an arrow labeled "DA" in FIG. 5D. As best seen in FIGS. 5C-5D, the reticle 26C moves towards the lead aim position based on the lead target position calculated by the processor 24 in earlier functions of the target lead estimation protocol 40, particularly the target locking function 40B and the slew measuring function 40C.

Figure 5E:
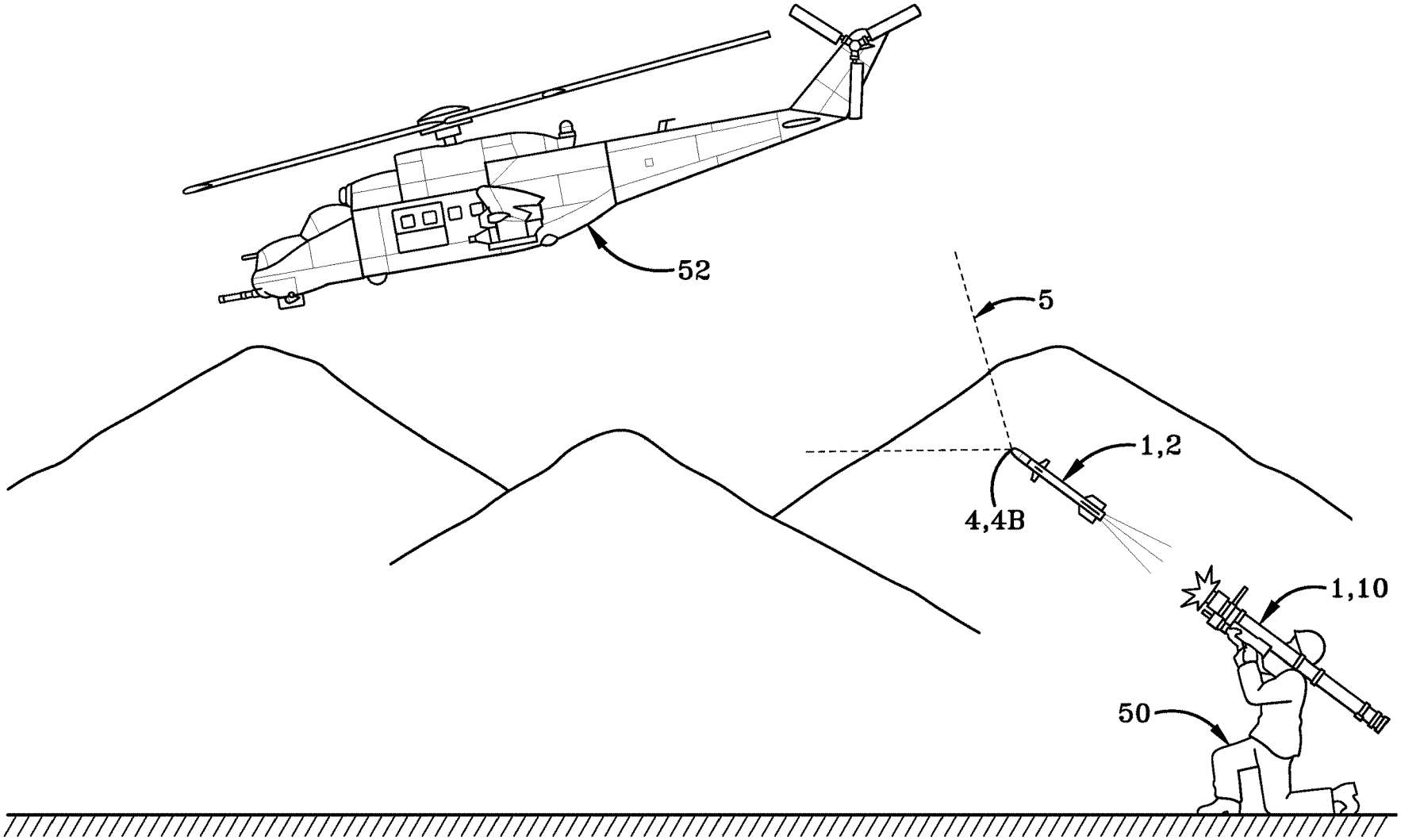
FIG. 5E (FIG. 5E) is another operational view following FIG. 5D, but an operator of the portable air defense system launches the missile from the launcher towards the aerial target based on the lead target position set by the reticle.

Once the lead aim position 56B is set for the reticle 26C, the operator may then launch and/or fire the missile 2 from the launcher 10. As best seen in FIG. 5E, the operator launches missile 2 from the launcher 10 upon actuating a trigger or launching mechanism of the grip stock 14. It should be noted that thermal battery 16 also provides a suitable amount of energy to initiate a rocket engine or motor of the missile 2 for launching purposes. Once launched, the guidance kit 4 of the missile 2 guides and/or directs the missile 2 towards the aerial target 52 based on the seeker device 4B and other suitable devices provided in the guidance kit 4 of the missile 2. It should be noted that once the missile 2 is launched, the missile 2 and the launcher 10 no longer communicate with one another.

Figure 6:
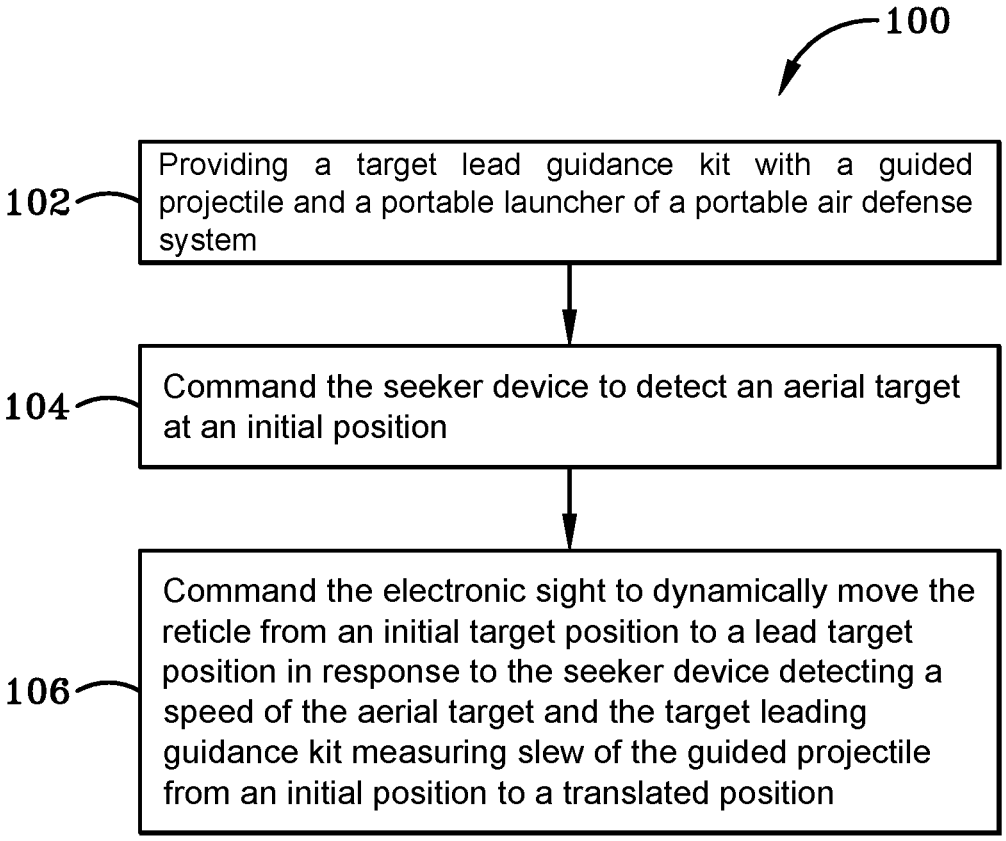
FIG. 6 (FIG. 6) is an exemplary method flowchart.

FIG. 6 illustrates a method 100. Initial step 102 of method 100 includes providing a target lead guidance kit with a guided projectile and a portable launcher of a portable air defense system, the target lead guidance kit comprises: an inertial measurement unit operably engaging with the guided projectile for tracking slew of the guided projectile; a processor operably engaging with the inertial measurement unit and in electrical communication with the inertial measurement unit; an electronic sight operably engaging with the portable launcher and in electrical communication with the inertial measurement unit, a seeker device of the guided projectile of the portable air defense system, and the processor and having a reticle; and a target lead estimation protocol stored on a computer readable media that is electrical communication with the processor. Another step 104 of method 100 includes the processor is configured to execute the target lead estimation protocol loaded on the computer readable media which, when executed by the processor, causes the processor to: command the seeker device to detect an aerial target at an initial position. Another step 106 of method 100 includes that the processor is configured to execute the target lead estimation protocol loaded on the computer readable media which, when executed by the processor, causes the processor to: command the electronic sight to dynamically move the reticle from an initial target position to a lead target position in response to the seeker device detecting a speed of the aerial target and the target leading guidance kit measuring slew of the guided projectile from an initial position to a translated position.

Additional and/or optional steps may be included with method 100. One optional step of method 100 may further include that when the target lead estimation protocol is executed by the processor, the processor is further caused to: lock onto the aerial target in response to the aerial target being detected by the seeker device upon executing a target locking function loaded on the computer readable media. Another optional step of method 100 may further include that when the target lead estimation protocol is executed by the processor, the processor is further caused to: measure the slew of the guided projectile in response to the inertial measurement unit detecting the slew of the guided projectile when the portable air defense system is tracking the aerial target upon executing a slew measuring function loaded on the computer readable media. Another optional step of method 100 may further include that when the target lead estimation protocol is executed by the processor, the processor is further caused to: calculate the lead target position of the aerial target in response to the seeker device detecting the speed of the aerial target and the guided projectile slewing from the initial position to the translated position upon executing a lead position function loaded on the computer readable media. Another optional step of method 100 may further include that when the target lead estimation protocol is executed by the processor, the processor is further caused to: dynamically move the reticle of the electronic sight from the initial target position to the lead target position upon executing a reticle adjustment function loaded on the computer readable media. Another optional step of method 100 may further include effecting the guided projectile to be launched from the portable launcher at the lead target position.

The device, assembly, or system of the present disclosure may additionally include one or more sensor to sense or gather data pertaining to the surrounding environment or operation of the device, assembly, or system. Some exemplary sensors capable of being electronically coupled with the device, assembly, or system of the present disclosure (either directly connected to the device, assembly, or system of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

The device, assembly, or system of the present disclosure may include wireless communication logic coupled to sensors on the device, assembly, or system. The sensors gather data and provide the data to the wireless communication logic. Then, the wireless communication logic may transmit the data gathered from the sensors to a remote device. Thus, the wireless communication logic may be part of a broader communication system, in which one or several devices, assemblies, or systems of the present disclosure may be networked together to report alerts and, more generally, to be accessed and controlled remotely. Depending on the types of transmitters installed in the device, assembly, or system of the present disclosure, the system may use a variety of protocols for communication.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A portable launcher to launch a guided projectile at an aerial target, wherein the guided projectile has a projectile guidance kit and a target leading guidance kit that is provided with the guided projectile and the portable launcher, the target leading guidance kit comprising:

an inertial measurement unit operably engaged with the guided projectile for tracking slew of the guided projectile inside of the portable launcher from an initial position to a translated position;

a processor in electrical communication with the inertial measurement unit;

an electronic sight operably engaging with the portable launcher and in electrical communication with the inertial measurement unit and the processor; and a target lead estimation protocol stored on a computer readable media and accessible by the processor;

wherein when the processor executes the target lead estimation protocol, the processor is instructed to dynamically lead a reticle of the electronic sight of the target leading guidance kit from an initial target position to a lead target position in response to the projectile guidance kit detecting a speed of the aerial target and the inertial measurement unit measuring the slew of the guided projectile from the initial position to the translated position.

2. The portable launcher of claim 1, wherein when the processor executes the target lead estimation protocol, the reticle is displayed on the electronic sight from the initial target position to the lead target position in response to a seeker device on the guided projectile detecting the speed of the aerial target and the inertial measurement unit detecting the slew of the guided projectile from the initial position to the translated position.

3. The portable launcher of claim 1, wherein the target lead estimation protocol comprises:

a target locking function stored on the computer readable media in electrical communication with the processor;

wherein the target locking function is executable by the processor to lock onto the target in response to the target being detected by the seeker device.

4. The portable launcher of claim 1, wherein the target lead estimation protocol further comprises:

a slew measuring function stored on the computer readable media and in electrical communication with the processor;

wherein the slew measuring function is executable by the processor to measure the slew of the guided projectile in response to the inertial measurement unit detecting the slew of the guided projectile from the initial position to the translated position.

5. The portable launcher of claim 1, wherein the target lead estimation protocol further comprises:

a lead position function stored on the computer readable media and in electrical communication with the processor;

wherein the lead position function is executable by the processor to calculate the lead target position in response to the seeker device detecting a speed of the aerial target and the inertial measurement unit measuring slew of the guided projectile from the initial position to the translated position.

6. The portable launcher of claim 1, wherein the target lead estimation protocol further comprises:

a reticle adjustment function stored on the computer readable media an in electrical communication with the processor;

wherein the reticle adjustment function is executable by the processor to dynamically move the reticle of the electronic sight from the initial target position to the lead target position that matches the lead target position.

7. The portable launcher of claim 1, further comprising:

a transceiver of the target leading guidance kit operably engaged with the portable launcher and is in electrical communication with a processor of the projectile guidance kit;

wherein the processor is in electrical communication with the electronic sight on the guided projectile via the transceiver.

8. The portable launcher of claim 1, wherein the computer readable media is a legacy component of the guided projectile and the target leading estimation protocol is configured to be uploaded and stored on the computer readable media.

* * * * *